US009906876B2

(12) United States Patent
Rosenkranz

(10) Patent No.: US 9,906,876 B2
(45) Date of Patent: Feb. 27, 2018

(54) METHOD FOR TRANSMITTING AN AUDIO SIGNAL, HEARING DEVICE AND HEARING DEVICE SYSTEM

(71) Applicant: SIVANTOS PTE. LTD., Singapore (SG)

(72) Inventor: Tobias Daniel Rosenkranz, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 15/489,953

(22) Filed: Apr. 18, 2017

(65) Prior Publication Data

US 2017/0311096 A1 Oct. 26, 2017

(30) Foreign Application Priority Data

Apr. 25, 2016 (DE) ..... 10 2016 206 985

(51) Int. Cl.
*H04R 25/00* (2006.01)
*G10L 19/008* (2013.01)

(52) U.S. Cl.
CPC ..... *H04R 25/552* (2013.01); *G10L 19/008* (2013.01); *H04R 25/505* (2013.01); *H04R 25/554* (2013.01); *H04R 2430/01* (2013.01)

(58) Field of Classification Search
CPC .. H04R 25/552; H04R 25/505; H04R 25/554; H04R 2430/01; G10L 19/008
USPC ..... 381/23.1, 60
See application file for complete search history.

(56) References Cited

U.S. PATENT DOCUMENTS 5,479,522 A * 12/1995 Lindemann ..... H04R 25/356 381/23.1
5,892,836 A * 4/1999 Ishige ..... H04R 25/505 381/316
2004/0044527 A1 3/2004 Thumpudi et al.
2010/0014679 A1 1/2010 Kim et al.
2011/0046966 A1 2/2011 Dalimba
2015/0201287 A1* 7/2015 Jespersgaard ..... H04R 25/50 381/321
2015/0264492 A1* 9/2015 Laudanski ..... H04R 1/10 381/60
2017/0303054 A1* 10/2017 Rosenkranz ..... H04R 25/554

OTHER PUBLICATIONS

J. Benesty, et al.; (2008), Linear Prediction. Springer Handbook of Speech Processing; 2008; pp. 111-125; Springer Verlag; ISBN: 978-3-540-49125-5.
B. Matschkal, et al. "Spherical logarithmic quantization", IEEE Trans Audio, Speech, and Language Processing; Jan. 2010; pp. 126-140; vol. 18.

* cited by examiner

*Primary Examiner* — David Ton
(74) *Attorney, Agent, or Firm* — Laurence A. Greenberg; Werner H. Stemer; Ralph E. Locher

(57) ABSTRACT

An audio signal is transmitted from a transmitter to a receiver in a hearing device, particularly a hearing aid. A communication facility configured for transmitting and/or receiving the audio signal. A hearing device system has two hearing devices configured to transmit audio signals between the two hearing devices by way of their communication facilities in accordance with the method.

17 Claims, 5 Drawing Sheets

METHOD FOR TRANSMITTING AN AUDIO SIGNAL, HEARING DEVICE AND HEARING DEVICE SYSTEM

CROSS-REFERENCE TO RELATED APPLICATION

This application claims the priority, under 35 U.S.C. § 119, of German patent application DE 10 2016 206 985.3, filed Apr. 25, 2016; the prior application is herewith incorporated by reference in its entirety.

BACKGROUND OF THE INVENTION

Field of the Invention

The invention relates to a method for transmitting an audio signal from a transmitter to a receiver. The invention also relates to a hearing device and to a hearing device system having two such hearing devices. The hearing device is preferably a hearing aid.

Persons who suffer from a reduction in their hearing power usually use a hearing aid. In this context, an environmental, ambient sound is in most cases detected by means of an electromechanical sound transducer. The detected electrical signals are processed by means of an amplifier circuit and fed into the auditory canal of the person by means of a further electromechanical transducer. Different types of hearing aids are known. The so-called "behind-the-ear devices" (BTE) are worn between the head and outer ear. The amplified sound signal is here fed into the auditory canal by means of an acoustic tube or sound tube. A further conventional embodiment of a hearing aid is an "in-ear device" (ITE) in which the hearing aid itself is introduced into the auditory canal. As consequence, the auditory canal is at least partially closed by means of this hearing aid so that apart from the sound signals generated by means of the hearing aid no further sound—or only greatly reduced sound—can penetrate into the auditory canal.

If the person suffers from an impairment of the hearing power of both ears, a hearing device system having two such hearing aids is utilized. In this arrangement, one of the hearing aids is in each case allocated to each of the ears. In order to provide spatial hearing for the person, it is required that the audio signals detected by one of the hearing aids are provided to the other hearing aid in each case. This requires, on the one hand, transmission with only a comparatively small offset in time. On the other hand, the head of the person acts as attenuation which is why the rate of transmission between the hearing aids is limited. In addition, a transmission power is limited because of the limited energy storage of the hearing aids and the burden on the person which is too strong otherwise.

SUMMARY OF THE INVENTION

It is accordingly an object of the invention to provide a method for transmitting an audio signal which overcomes the above-mentioned and other disadvantages of the heretofore-known devices and methods of this general type and which is particularly suitable for transmitting an audio signal from a transmitter to a receiver and which is particularly suitable for hearing device and a hearing device system having two hearing devices. It is a primary object to provide for an audio quality to be improved and, preferably, a transmission rate to be reduced.

With the foregoing and other objects in view there is provided, in accordance with the invention, a method for transmitting an audio signal from a transmitter to a receiver, the method comprising:

at a transmitter end, dividing an input signal representing the audio signal into a plurality of channels for a particular time window;

at the transmitter end, allocating a current channel value to each channel of the plurality of channels;

at the transmitter end, generating a plurality of prognostic values by way of preceding channel values that are allocated to a time window preceding in time, and allocating one of the prognostic values to each current channel value;

at the transmitter end, determining a reference value;

at the transmitter end, determining a gain factor by way of the reference value and allocating the gain factor to one of the prognostic values, and modifying the current channel value associated with the one prognostic value by the gain factor to form an adapted channel value;

at the transmitter end, allocating the adapted channel value to an adapted data record;

transmitting a transmission value corresponding to the adapted data record from the transmitter to the receiver;

at a receiver end, generating a reconstructed adapted data record with a reconstructed adapted channel value which corresponds to the adapted channel value by way of the transmission value;

at the receiver end, generating a plurality of receiver-end prognostic values by way of reconstructed preceding channel values, one of the receiver-end prognostic values being allocated to the reconstructed adapted channel value;

at the receiver end, allocating a receiver-end gain factor to the reconstructed adapted channel value by way of the allocated receiver-end prognostic value;

at the receiver end, modifying the reconstructed adapted channel value by way of the receiver-end gain factor to form a reconstructed channel value; and at the receiver end, adding the reconstructed value to a reconstructed output signal.

In other words, the method is used for transmitting an audio signal from a transmitter to a receiver, the transmitter or the receiver preferably being a component of a hearing device. The remaining element in each case, that is to say the transmitter or the receiver, respectively, is suitably a component of a further structural part of a hearing device system having the hearing device.

For example, the hearing device is a head set or includes a head set. Particularly preferably, however, the hearing device is a hearing aid. The hearing aid is used for supporting a person suffering from a reduction of their hearing power. In other words, the hearing aid is a medical device by means of which, for example, a partial loss of hearing is compensated for. The hearing aid is, for example, a "receiver-in-the-canal" hearing aid (RIC), an in-ear hearing aid such as an "in-the-ear" hearing aid, an "in-the-canal" hearing aid (ITC) or a "complete-in-canal" hearing aid (CIC), hearing-aid glasses, a pocket hearing aid, a bone conduction hearing aid or an implant. Particularly preferably, the hearing aid is a "behind-the-ear" (BTE) hearing aid which is worn behind an outer ear.

The method provides that, at the transmitter end an input signal corresponding to the audio signal is temporally subdivided into time windows, the length of the time windows being preferably identical. The length of the time windows is, for example, between 0.5 ms and 2 ms and particularly equal to 1 ms. The input signal is preferably the audio signal or a part thereof. For example, the audio signal is split into different input signals, each input signal being subdivided into different time windows in each case. The time windows, for example their length, differ in particular in the case of different input signals. For a particular time window, the input signal is divided at the transmitter end into a number of channels. The channels are here, for example, frequency channels. At the transmitter end, a current channel value is allocated to each frequency channel. The current channel value is, for example, an amplitude and/or a phase or a signal level. The current channel value is, in particular, a complex value and has a real and an imaginary part.

At the transmitter end, a number of prognostic values is generated for the current channel values by means of preceding channel values, one of the prognostic values being allocated to each of the current channel values. For example, the generation occurs in such a manner that a difference between the respective prognostic value and the current channel value allocated is as small as possible. At least, however, one of the current channel values is allocated one-to-one to each of the prognostic values. In other words, precisely the same number of prognostic values are created as there are current channel values. The preceding channel values have been allocated to a time window preceding in time, for example the time window preceding directly in time. In other words, a time window preceding in time has already been divided into the number of channels and to each of these channels a preceding channel value has just in time been allocated. If the method is carried out, for example, for the first time, the value zero (0), for example, is used for all preceding channel values for initialization. As soon as a second time window is present for the first time, the preceding channel values, for example, are allocated to the first time window in time and the current channel values are allocated to the subsequent time window. For example, a number of channel values preceding in time are used for creating the prognostic values, a number of preceding channel values which are allocated to the same time windows preceding in time being used, for example, for each of the prognostic values. Alternatively or in combination therewith, a number of preceding channel values which are allocated to different time windows preceding in time is used for each of the prognostic values.

At the transmitter end, a reference value is determined, the reference value having a particular characteristic and, for example, not deviating from a particular predetermined value, or deviating only to a slight extent. Alternatively, the reference value deviates from the particular predetermined value by the slightest amount. Furthermore, a gain factor which is determined by means of the reference value is allocated to a prognostic value at the transmitter end. The current channel value allocated to this prognostic value is modified by means of the gain factor to form an adapted channel value. In summary, a gain factor is allocated in consequence to one of the prognostic values and the gain factor is used for modifying the current channel value which is allocated to the same prognostic value to form the adapted channel value. For example, the current channel value is multiplied by the gain factor or the gain factor is added to the allocated current channel value for generating the adapted channel value. If the current channel value is, for example, a complex value, the gain factor is preferably applied both to the real component and to the imaginary component, thus both parts are modified by means of the same gain factor. In summary, the current channel value is used as argument of a function which has the gain factor at least as a parameter. The result of the function is the adapted channel value.

At the transmitter end, the adapted channel value is allocated to an adapted data record. In consequence, the adapted data record has the adapted channel value. For example, the adapted data record has other values, the adapted data record preferably exhibiting exactly the same number of values as there are current channel values present. A transmission value corresponding to the adapted data record is transmitted from the transmitter to the receiver, the transmission value suitably being generated firstly at the transmitter end by means of the adapted data record. The transmission value preferably has a lesser dimensionality or at the most the same dimensionality as the adapted data record and is, for example, a unidimensional value.

At the receiver end, a reconstructed adapted data record is generated by means of the transmission value, which corresponds to the adapted data record present at the transmitter end. For this purpose, the inverse function, in particular, is designed for generating the transmission value by means of the adapted data record. The reconstructed adapted data record generated in this way thus essentially corresponds to the adapted data record present at the transmitter end, there being differences preferably only due to the generation of the transmission value. In particular, if the function for generating the transmission value were to be applied to the reconstructed adapted data record, the transmission value would be obtained again. The reconstructed data record thus has a reconstructed adapted channel value which corresponds to the adapted channel value and, in particular, is equal to the adapted channel value.

Furthermore, at the receiver end, a number of receiver-end prognostic values is generated by means of reconstructed preceding channel values, the reconstructed preceding channel values corresponding particularly to the preceding channel values present at the transmitter end and suitably conform to these. For example, the receiver-end prognostic values are generated by means of the same calculating rule as the prognostic values which are present at the transmitter end. The reconstructed preceding channel values have suitably been reconstructed during a preceding execution of the method and, in particular, are allocated to a window preceding in time, preferably to the same time, window preceding in time to which the channel values preceding at the transmitter end are allocated. For example, zero (0) is allocated to the reconstructed preceding channel values when the method is executed for the first time.

In particular, the number of receiver-end prognostic values corresponds to the number of prognostic values which are present at the transmitter end. One of the receiver-end prognostic values is allocated to the reconstructed adapted channel value. In particular, that receiver-end prognostic value which was generated by means of the same data as the prognostic value which is allocated to the adapted channel value present at the transmitter end is allocated to the reconstructed adapted channel value. Furthermore, a receiver-end reference value is determined at the receiver end, the same procedure as that for determining the reference value present at the transmitter being selected for determining the receiver-end reference value.

Furthermore, at the receiver end, a receiver-end gain factor is allocated to the reconstructed adapted channel value. For this purpose, the receiver-end gain factor is firstly allocated to the receiver-end prognostic value which is allocated to the reconstructed adapted channel value, and via this gain factor, the receiver-end gain factor is just allocated to the adapted channel value. In addition, at the receiver end, the reconstructed adapted channel value is modified by means of the receiver-end gain factor to form a reconstructed channel value. In this context, in particular, an inverse function to the function is performed by means of which the current channel value present at the transmitter end is modified to form the adapted channel value. In other words, the adapted channel value is divided by the receiver-end gain factor or the receiver-end gain factor is subtracted from the reconstructed adapted channel value. In other words, the inverse operation is used. As an alternative to this, the same calculating rule is used but the receiver-end gain factor is the inverse element. In summary, the reconstructed channel value corresponds to the current channel value to which the gain factor is allocated at the transmitter end and, in particular, the two channel values correspond to each other, any differences preferably being present only due to the generation of the transmission value.

At the receiver end, the reconstructed channel value is added/combined to/with a reconstructed output signal. In particular, yet more values of the reconstructed adapted data record or values generated by means of the reconstructed adapted data record are combined/added with/to the reconstructed output signal. In particular, the reconstructed output signal corresponds to the input signal distributed to the channels/the totality of the current channel values. For example, the reconstructed output signal is processed further at the receiver end and the individual channels are combined and, for example, transferred into the time domain, if the channels correspond to individual frequencies. For example, the channel values of the reconstructed output signal are used as reconstructed preceding channel values when the method is executed again and by means of these, at least the receiver-end prognostic values are generated. In particular, the method is carried out again after the particular time window has elapsed.

Due to the adaptation of the current channel value, by means of the gain factor, a noise which is introduced due to the generation of the transmission value can be suitably distributed to the current channel values or reconstructed channel values so that an audio quality is increased. Due to the use of the transmission value, a data set to be transmitted is reduced. Since the gain factors are determined both at the receiver end and at the transmitter end, transmitting this value is not required which reduces a required transmission rate during the transmission.

For example, the reference value is allocated to a particular current channel value and/or one of the prognostic values, there being no adaptation of this current channel value by means of a gain factor, in particular, if this current channel value is allocated to the adapted data record.

The receiver-end reference value is suitably allocated to one of the receiver-end prognostic values. For example, a fixed value (e.g. 0 dB), the minimum of the prognostic values or the prognostic value allocated to a particular channel is utilized as reference value. Particularly preferably, however, the maximum of the prognostic values is utilized as reference value. In other words, the largest of the prognostic values is determined both at the transmitter and particularly at the receiver. Suitably, in this context, at the transmitter end, the current channel value, to which the maximum of the prognostic values is allocated, is also allocated to the adapted data record, and, at the receiver end, the reconstructed adapted data record is generated using the transmission value with the reconstructed adapted channel value which corresponds to the adapted channel value and with a reconstructed unadapted channel value which corresponds to the current channel value allocated to the maximum of the prognostic values. At the receiver end, the reconstructed channel value and the reconstructed unadapted channel value are combined to form the reconstructed output signal. Due to the use of the maximum, the current channel value which is allocated to the largest of the prognostic values and most probably is also the largest of the current channel values is not changed, whereas at least one of the remaining current channel values is changed. In particular, the gain factor is selected here in such a manner that the deviation between the allocated prognostic value and the reference value would be greater than a deviation between the reference value and the prognostic value modified by means of the gain factor. In consequence, a deviation between the adapted channel value and the current channel value allocated to the reference value is also most probably reduced which is why any noise introduced during the generation of the transmission value is only present to a reduced extent in the reconstructed channel value. The reconstructed unadapted channel value present at the receiver end is suitably not changed.

The gain factor is preferably chosen in such a manner that a deviation between the prognostic value allocated to these and the reference value would be greater than a deviation between the reference value and the prognostic value modified by means of the gain factor. In other words, the deviation between the reference value and the prognostic value just modified would be reduced with an application of the gain factor to the prognostic value to which the gain factor is allocated. In as much as, in consequence, a deviation between the prognostic values and the current channel values is comparatively low, a deviation between the adapted channel value and the current value, to which the maximum of the prognostic values is allocated, is, therefore, also reduced. In as much as, due to the generation of the transmission value noise is introduced which is in dependence on the current channel value to which the reference value is allocated, the noise which the reconstructed channel value exhibits is thus reduced due to the use of the receiver-end gain factor and of the gain factor.

The reconstructed unadapted channel value is suitably allocated to the same channel as the current channel value to which the reference value is allocated. For example, the reconstructed channel value is allocated to the same channel which is allocated to the current channel value at the transmitter end, to which the gain factor is allocated. Preferably, the preceding channel value allocated to the same channel is utilized as prognostic value. In other words, the respective preceding channel value is utilized as prognostic value for each of the current channel values. In this manner, an effort for generating the prognostic values is reduced. If the input signal thus has comparatively low fluctuations, a deviation between the prognostic value and the respective allocated current channel value is comparatively low. In particular, the reconstructed preceding channel values are also used as receiver-end prognostic values, the allocation to the respective channels also being taken into consideration in this respect.

In an alternative to this, a linear projection is utilized for generating the prognostic values or the receiver-end prognostic values, respectively, using, for example, a number of channel values preceding in time. In other words, each of the prognostic values is generated by means of a linear combination, using, for example, a number of channel values preceding in time.

It is suitably determined by means of the receiver-end reference value which of the values of the adapted data record is the reconstructed unadapted channel value. In this context, firstly the receiver-end prognostic values are generated and to each of the values of the reconstructed adapted data record one of the receiver-end prognostic values is allocated. The value of the reconstructed adapted data record to which the receiver-end reference value is allocated is utilized as reconstructed unadapted channel value. Alternatively, an index or the like is allocated to each value of the reconstructed adapted data record, on the basis of which an allocation to the respective channels is effected.

Particularly preferably, the gain factor is generated by means of the prognostic value to which the gain factor is allocated. The receiver-end gain factor is suitably generated by means of the receiver-end prognostic value to which the reconstructed adapted channel value is allocated. In this way, it is not required to transmit the gain factors or values corresponding thereto between the receiver and the transmitter which further reduces a data set to be transmitted. In particular, the same computing rule is used for generating the gain factor or the receiver-end gain factor, respectively.

The gain factor is suitably generated by means of the difference between the reference value and the prognostic value. In other words, the difference between the reference value and the prognostic value, to which the gain factor is to be allocated, is first generated. By means of this difference, the gain factor is determined. In particular, the gain factor is the difference which, for example, is multiplied by means of a factor, the factor suitably being chosen to be constant. In particular, the difference between the receiver-end prognostic value to which the reconstructed adapted channel value is to be allocated and the receiver-end reference value is also determined at the receiver end and the receiver-end gain factor is determined by means of this difference. In particular, the receiver-end gain factor is the difference which, for example, is multiplied by a factor. In this way, the determination of the gain factor is comparatively simple. In addition, an adaptation of the adapted channel value is in this way such that a deviation with respect to the current channel value allocated to the reference value is reduced. In this context, current changes of the input signal are also taken into consideration which, for example, would not be the case with a fixed specification of the gain factors.

In particular, to each of the remaining prognostic values, a gain factor is allocated in each case and these are preferably adapted in each case by means of the allocated gain factor and allocated to the adapted data record. At the receiver end, a number of reconstructed adapted channel values is thus present, a receiver-end gain factor being allocated to each of these by means of which in each case reconstructed channel values are generated which are combined to form the reconstructed output signal. In other words, all current channel values with the exception of that current channel value to which the reference value is allocated are modified by means of the respective gain factor and the channel values adapted in this way are transmitted by means of the transmission value. At the receiver, the reconstructed output signal is generated by means of the reconstructed adapted channel values and the gain factors present at the receiver end, which output signal thus corresponds particularly to the input signal. The adapted data record here has only a single current channel value, namely the one to which the reference value is allocated. In particular, the receiver-end reference value is determined at the receiver end so that it can be determined comparatively simply which of the values of the reconstructed adapted data record is not to be changed with a gain factor.

Preferably, the receiver-end prognostic values and the prognostic values which are present at the transmitter and also the gain factor and the receiver-end gain factor are essentially generated simultaneously. This reduces a period of time which is used for transmitting the audio signal. In particular, a period of time between detection of the input signal and generation of the reconstructed output signal is shortened in this way.

The individual gain factors and the individual receiver-end gain factors preferably differ. These are suitably determined in each case by means of the respective prognostic value and the reference value or the receiver-end prognostic value and the receiver-end reference value, suitably by means of their difference. The gain factor is suitably $$G_i = w\Delta L_i$$

where w is a constant factor and $\Delta L_i$ designates the difference between the reference value and the $i^{th}$ prognostic value or the receiver-end reference value and the $i^{th}$ receiver-end prognostic value, respectively, i identifying the respective channel to which the respective prognostic value or receiver-end prognostic value is allocated. In this way, essentially all current channel values are adapted to an almost equal level with the current channel value to which the reference value is allocated. Thus, all values of the adapted data record essentially have the same magnitude which is why any noise is essentially uniformly distributed to all reconstructed adapted channel values and the reconstructed unadapted channel value. After application of the receiver-end gain factors, the noise is thus less in the case of the reconstructed channel values than in the case of the reconstructed unadapted channel value. In particular, if the maximum is utilized as reference value, a noise is therefore reduced with comparatively low current channel values which improves an audio quality.

For example, the input signal is divided into the frequency channels by means of a Fourier transform. Particularly preferably, however, band-pass filters are used which are preferably combined to form a filter bank. Alternatively or in combination therewith, a difference between a predicted audio signal and the actual audio signal is used as input signal, the audio signal firstly being divided into the channels or channels deviating therefrom and the predicted audio signal being generated by means of a linear projection.

In summary, the predicted audio signal is determined by way of the formula $$\hat{x}(n) = \sum_{i=1}^{N} a_i y(n-i)$$

or $$\hat{x}(n) = \sum_{i=1}^{N} A y(n-i)$$

where $\hat{x}(n)$ designates the channels of the predicted audio signal, $a_i$ designates a coefficient, A is a coefficient matrix and y represents the totality of the values which are utilized for the generation, in particular the value preceding in time of the audio signal divided into the channels. The time of generation is here n–i and the number used is N. A type of linear projection is, for example, disclosed in "Benesty, J., Chen, J. & Huang, Y. (Arden). (2008), Linear Prediction. In J. Benesty, M. M. Sondhi & Y. (Arden) Huang (Editors), Springer Handbook of Speech Processing (pages 111-125) Springer Verlag", particularly in chapter 7.2 (page 112-113), particularly formula 7.6 and particularly in chapter 7.9 (page 120-124), particularly formula 7.108. The input signal used is, for example, the totality of the difference between the respective $\hat{x}(n)$ and the corresponding y(n).

For example, the transmission value is generated by means of quantization of the adapted data record. In this context, the transmission value which suitably can assume only a discrete number of different values is allocated to the adapted data record. In other words, the transmission value is a discrete value.

By means of the transmission value and by means of the gain factor, a transmitter-end reconstructed channel value and a transmitter-end reconstructed unadapted channel value are preferably generated at the transmitter end. The transmitter-end reconstructed channel value corresponds to the reconstructed channel value which is present at the receiver and the transmitter-end reconstructed unadapted channel value corresponds to the reconstructed unadapted channel value which is present at the receiver. The transmitter-end reconstructed channel value and the transmitter-end reconstructed unadapted channel value are present at the transmitter.

In other words, the reconstructed output signal is generated at the transmitter end also by means of the transmission value and the gain factor, this output signal being able to deviate slightly from the input signal due to the quantization and the resultant introduced noise. In the case of a transmission following in time, the transmitter-end reconstructed channel value and the transmitter-end reconstructed unadapted channel value are utilized as the channel values preceding in time or at least as a part thereof. In this way, deviations between the output signal and the input signal, resulting from the quantization, are taken into consideration during the generation of the prognostic values which is why a maximum deviation between the input signal and the reconstructed output signal remains slight even with a repeated carrying out of the method, and thus a high quality is present when the audio signal is transmitted.

Suitably, a scalar quantization is utilized. Especially preferably, the quantization is a vector quantization. A so-called gain-shape vector quantization is suitably utilized. The quantized signal is then divided into the signal form/vector form (shape) and a scaling factor (gain). A particularly suitable form of the gain-shape vector quantization is represented by the logarithmic vector quantization, particularly the (spherical) logarithmic vector quantization. In this context, possible signal forms/vector forms are points on a (potentially) high-dimensional unit sphere (i.e. with a radius of 1). The scaling factor is here quantized logarithmically, for example with the familiar A law. As signal forms/vector forms, other forms also come into consideration such as, for example, (high-dimensional) pyramids or cubes. A spherical/logarithmic vector quantization is known, for example, from "B. Matschkal and J. B. Huber, "Spherical logarithmic quantization", IEEE Trans. Audio, Speech, and Language Processing, vol. 18, pp. 126-140, January 2010", particularly from chapter III, an example being disclosed in chapter IV, particularly in FIGS. 8 and 9.

The hearing device has a communication facility for transmitting and/or receiving an audio signal. For this purpose, the communication facility comprises a transmitter and a receiver, respectively. The communication facility is suitable and provided and configured to perform a method for transmitting an audio signal from the transmitter and to the receiver, respectively. In this context, the method provides that, at the transmitter end, an input signal corresponding to the audio signal is divided into a number of channels for a particular time window and that, at the transmitter end, a current channel value is allocated to each channel. Furthermore, at the transmitter end, a number of prognostic values is generated by means of preceding channel values which are allocated to a time window preceding in time, one of the prognostic values being allocated to each current channel value and, at the transmitter end, a reference value is determined. At the transmitter end, a gain factor determined by means of the reference value is allocated to one of the prognostic values and the current channel value allocated to this prognostic value is modified by means of the gain factor to form an adapted channel value. In a further operating step, at the transmitter end, the adapted channel value is allocated to an adapted data record. A transmission value corresponding to the adapted data record is transmitted from the transmitter to the receiver.

At the receiver end, a reconstructed adapted data record with a reconstructed adapted channel value which corresponds to the adapted channel value is generated by means of the transmission value. At the receiver end, a number of receiver-end prognostic values is generated by means of reconstructed preceding channel values which, in particular, are allocated to the time window preceding in time, one of the receiver-end prognostic values being allocated to the reconstructed adapted channel value. Furthermore, a receiver-end reference value, especially of the receiver-end prognostic values, is determined especially at the receiver end and, at the receiver end, a receiver-end gain factor, which is preferably determined by means of the receiver-end reference value, is allocated to the reconstructed adapted channel value by means of the allocated receiver-end prognostic value. At the receiver end, the reconstructed adapted channel value is modified by means of the receiver-end gain factor to form a reconstructed channel value. In a further operating step, the reconstructed channel value is combined to form a reconstructed output signal at the receiver end.

If the communication facility only comprises the transmitter, only the transmitter-end operating steps and an operating step for transmitting the deviations are then performed, in particular. If the communication facility only has the receiver, only the receiver-end operating steps and an operating step for receiving the deviations are performed, in particular. The transmission is suitably wireless, for example inductive or by radio.

The hearing device preferably comprises a sensor by means of which an audio signal is detected during operation. The sensor is preferably an electromechanical sound transducer such as a microphone. For example, the input signal is the audio signal or the input signal is generated by means of the audio signal. For example, the input signal is a part of the audio signal or corresponds to a particular frequency range of the audio signal. To generate the input signal from the audio signal, the hearing device comprises, for example, a signal processing unit and/or filter. The hearing device preferably comprises an amplifier circuit by means of which the audio signal/output signal/reconstructed output signal can be amplified. The hearing device preferably comprises an actuator by means of which a sound signal is generated, like a loudspeaker, and which is suitable, and, for example, is provided and suitable for outputting the output signal or the reconstructed output signal, respectively.

For example, the hearing device is a headset or comprises a headset. Particularly preferably, the hearing device is a hearing aid, however. The hearing aid is used for supporting a person suffering from a reduction of the hearing power. In other words, the hearing aid is a medical device by means of which, for example, a partial loss of hearing is compensated for. The hearing aid is, for example, a "receiver-in-the-canal" hearing aid (RIC), an in-ear hearing aid such as an "in-the-ear" hearing aid, an "in-the-canal" hearing aid (ITC) or a "complete-in-canal" hearing aid (CIC), hearing-aid glasses, a pocket hearing aid, a bone conduction hearing aid or an implant. Particularly preferably, the hearing aid is a "behind-the-ear" hearing aid which is worn behind an outer ear.

The hearing device is particularly provided and configured to be worn on the human body. In other words, the hearing device preferably comprises a holding device by means of which attachment to the human body is possible. If the hearing device is a hearing aid, the hearing device is provided and configured to be arranged, for example, behind the ear or inside an auditory canal. In particular, the hearing device is cableless, or cordless, and provided and configured to be introduced at least partially into an auditory canal. For example, the hearing device is a component of a hearing device system which comprises a further hearing device or a further device such as a directional microphone or another device having a microphone. In this context, the device preferably comprises the transmitter and the hearing device comprises the receiver and the transmission of the audio signal between the transmitter and the receiver occurs in accordance with the method.

The hearing device system preferably comprises two hearing devices which have in each case a communication facility which are provided and configured for transmitting and/or receiving an audio signal according to the above method. In this context, the hearing device system is suitable and provided and configured to transmit audio signals between the two hearing devices by means of their respective communication facilities, the above method being performed. In particular, each of the communication facilities has in each case a transmitter and a receiver and the audio signals are transmitted between the two communication facilities, at least from one of the hearing devices to the remaining one. The transmission is suitably wireless, for example inductive or by means of radio.

Particularly preferably, the hearing device system is a hearing aid system. The hearing aid system is used for supporting a person suffering from reduction of the hearing power. In other words, the hearing aid system is a medical device by means of which, for example, a partial loss of hearing is compensated for. The hearing aid system suitably comprises a "behind-the-ear" hearing aid which is worn behind an outer ear, a "receiver-in-the-canal" hearing aid (RIC), an in-ear hearing aid, such as an "in-the-ear" hearing aid, an "in-the-canal" hearing aid (ITC) or a "completely-in-canal" hearing aid (CIC), hearing-aid glasses, a pocket hearing aid, a bone conduction hearing aid or an implant. The hearing device system is particularly provided and configured to be worn on the human body. In other words, the hearing device system preferably comprises a holding device by means of which attachment to the human body is enabled. If the hearing device system is a hearing aid system, at least one of the hearing devices is provided and configured to be arranged, for example, behind the ear or inside an auditory canal. In particular, the hearing device system is cordless and provided and configured to be introduced at least partially into an auditory canal. Particularly preferably, the hearing device system comprises an energy store by means of which an energy supply is provided.

In summary, the invention provides, in particular, for the audio signal to be split into frequency channels. Following this, a vector is formed by a set of channel values and one of a reference value and application of a gain factor to all elements of the vector, the gain factors preferably differing. If the reference value is a current channel value, no gain factor is preferably applied to it. The gain factor is calculated as a function of preceding (past, "reconstructed") channel values and, therefore, information which is present both at the transmitter and at the receiver end is used. A preceding channel value is here understood to be, for example, a quantized channel value or a reconstructed channel value in the sense of a predictive coding (i.e. as a sum of deviation and prognosis). The channel values adapted in this manner are vector quantized. Following this, the inverse gain factor is applied to the values that are now quantized.

The further developments and advantages described in conjunction with the method are analogously also to be transferred to the hearing device or the hearing device system, respectively, and conversely.

Other features which are considered as characteristic for the invention are set forth in the appended claims.

Although the invention is illustrated and described herein as embodied in a method for transmitting an audio signal, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

Parts and elements that correspond to one another are identified with the same reference symbols in all figures.

DETAILED DESCRIPTION OF THE INVENTION

Figure 1:
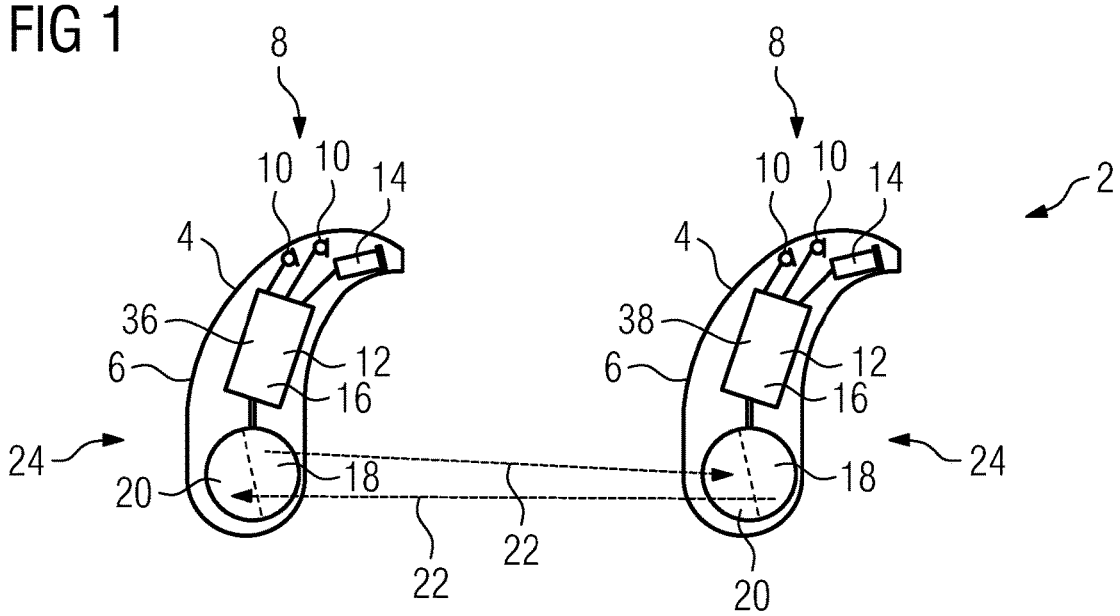
FIG. 1 shows diagrammatically a hearing device system with two hearing devices.

Referring now to the figures of the drawing in detail and first, particularly, to FIG. 1 thereof, there is shown a hearing device system 2 having two structurally identical hearing aids 4, which are provided and configured to be worn behind an ear of a user. In other words, they are in each case a "behind-the-ear" hearing aid which has a non-illustrated sound tube, or acoustic tube, which is introduced into the ear to connect a receiver in the ear canal. Each hearing aid 4 comprises a housing 6 which is manufactured from a plastic material. Within the housing 6, a microphone 8 having two electromechanical sound transducers 10 is arranged. By means of the two electromechanical sound transducers 10, a directional characteristic of the microphone 8 can be changed in that a temporal offset between the acoustic signals detected by way of the respective electromechanical sound transducer 10 is changed. The two electromechanical sound transducers 10 are coupled with respect to signals to a signal processing unit 12 which comprises an amplifier circuit. The signal processing unit 12 is formed by means of circuit elements such as, for example, electrical and/or electronic components.

Furthermore, the signal processing unit 12 is connected to a loudspeaker 14 by means of which the audio signals 16 recorded by the microphones 8 and/or processed by the signal processing unit 12 are output as sound signals. These sound signals are conducted into the ear of a user of the hearing device system 2 by way of the acoustic tube.

Each of the hearing aids 4 also has a transmitter 18 and a receiver 20, also referred to as a transceiver, by means of which data signals 22 are exchanged between the two hearing aids 4. The exchange is wireless, for example by means of radio or inductive transmission. The signal processing unit 12, the transmitter 18 and the receiver 20 here together in each case form a communication facility 24. The exchange of the data signals 22 enables a spatial hearing sensation to be conveyed to the wearer of the hearing device system 2. In summary, the hearing device system 2 is a binaural system.

Figure 2:
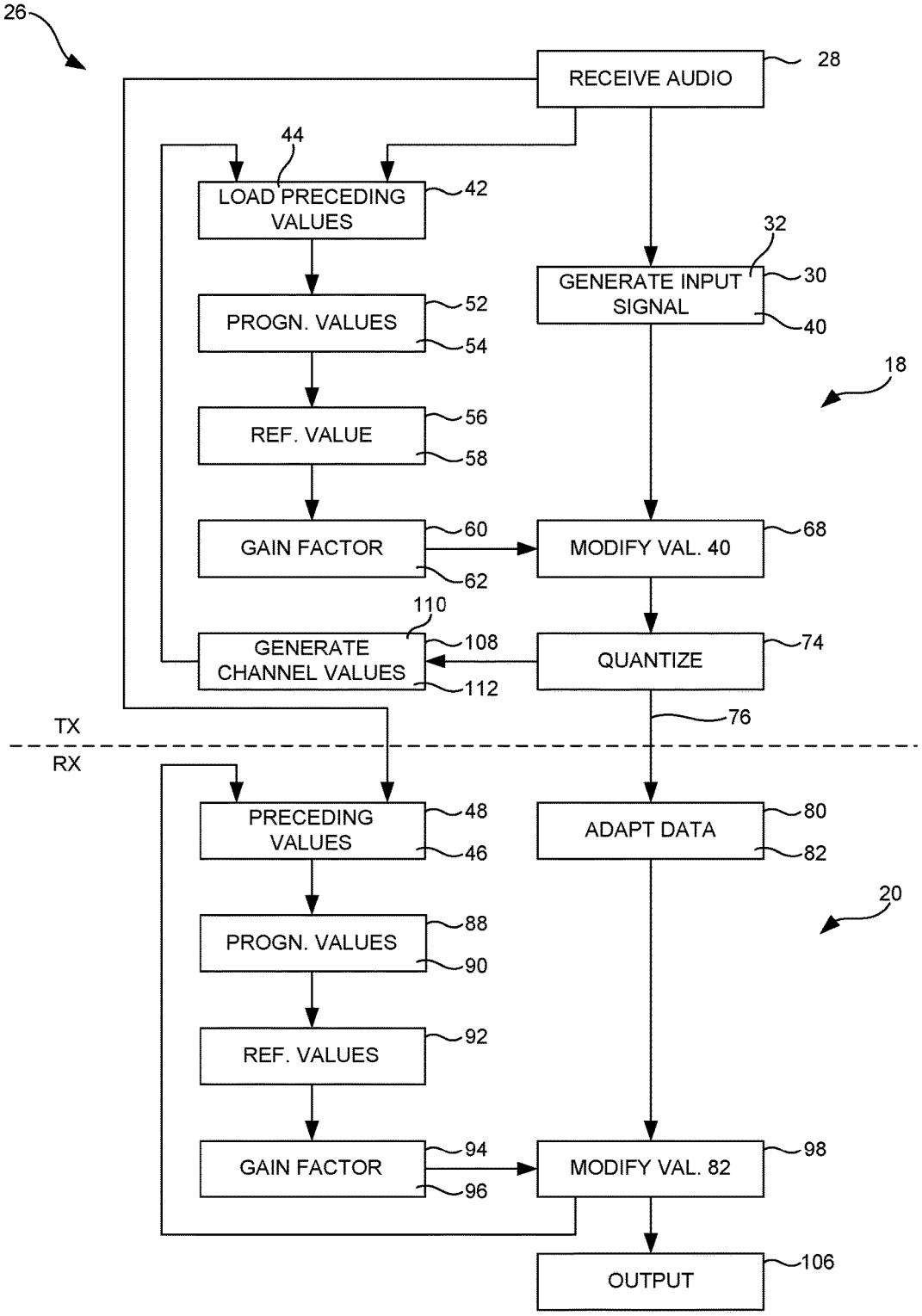
FIG. 2 is a flow diagram illustrating a method for transmitting an audio signal between the two hearing devices.
Figure 3:
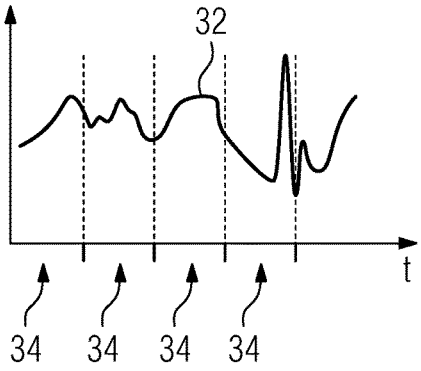
FIG. 3 shows an input signal corresponding to the audio signal.
Figure 4:
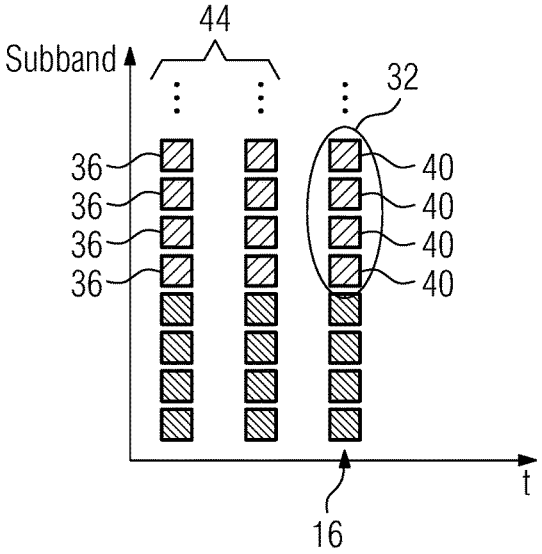
FIG. 4 shows the input signal divided into a number of channels.

In FIG. 2, a method 26 is shown according to which the audio signals 16 are transmitted between the two hearing devices 4 by means of their respective communication facility 24. In a first operating step 28, the audio signal 16 is received by means of one of the hearing aids 4. In a subsequent second operating step 30, an input signal 32 is generated from this which, in consequence, corresponds to the audio signal 16 and which is shown in FIG. 3 by way of example. For this purpose, the audio signal 16 is especially filtered. Furthermore, the input signal 32 is subdivided into time windows 34 which have the same length in time and which, for example, is equal to one millisecond. As soon as the last time window 34 in time is ended, this time window 34 is divided into a number of channels 36 as shown, for example, in FIG. 4. The channels 36 are frequency channels and for dividing the input signal 32 into the individual frequency channels 36, frequency-pass filters 38 are utilized which are present within the signal processing unit 16. Furthermore, the input signal 32 only comprises the channels 36 whereas the audio signal 16 has the channels 36 and yet further frequency channels. To each of the frequency channels 36, a particular current channel value 40 is allocated. In summary, the input signal 32 is divided into the individual frequency channels 36 in the second operating step 30 and discretized by means of the allocation of the current channel value 40.

Furthermore, after execution of the first operating step 16 at the transmitter 18, a third operating step 42 is carried out in which channel values 44 preceding in time are filled. These have been determined, for example, in a preceding run of the method 26 or, if the method 26 has not yet been carried out, standard values are utilized for this purpose such as zero (0). As well, a fourth operating step 46 is carried out at the receiver 20 in which reconstructed preceding channel values 48 are determined. These correspond to the channel values 44 preceding in time and are determined in the same way as the channel values 44 preceding in time.

Figure 5:
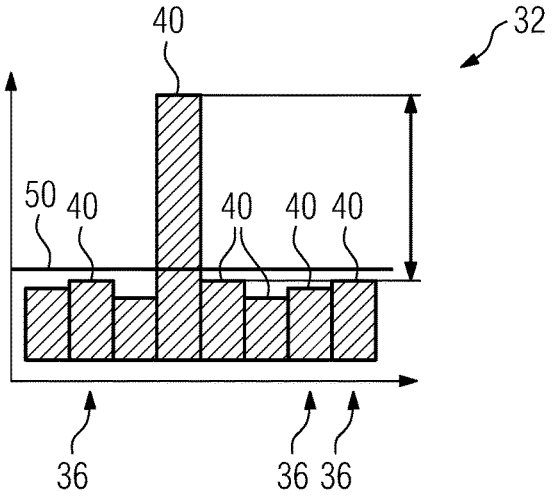
FIG. 5 shows current channel values.

In FIG. 5, the current channel values 40 are shown, each of which is in each case allocated to a channel 36. One of the current values 40 is comparatively large in this case. In an application of a spherically logarithmic quantization to the input signal 32, a first noise level 50 would be introduced due to the increased current channel value 40 which is greater than the remaining actual channel values 40 in wide parts such that these values would be excessively corrupted.

Figure 6:
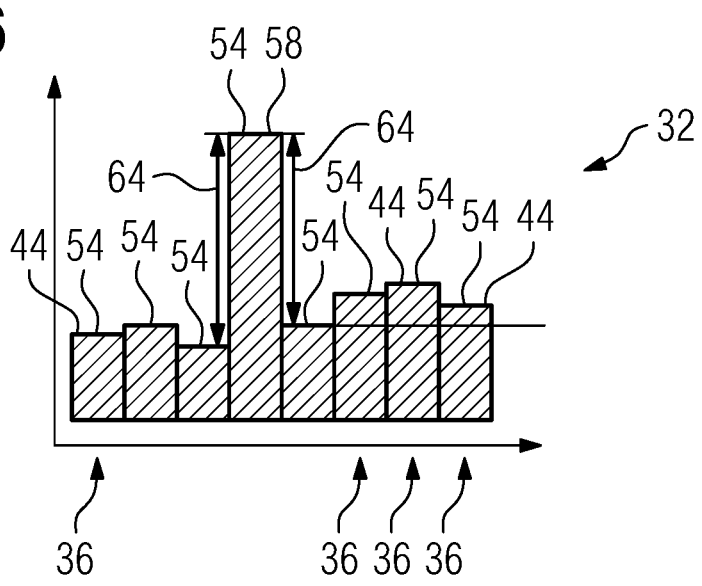
FIG. 6 shows prognostic values.
Figure 7:
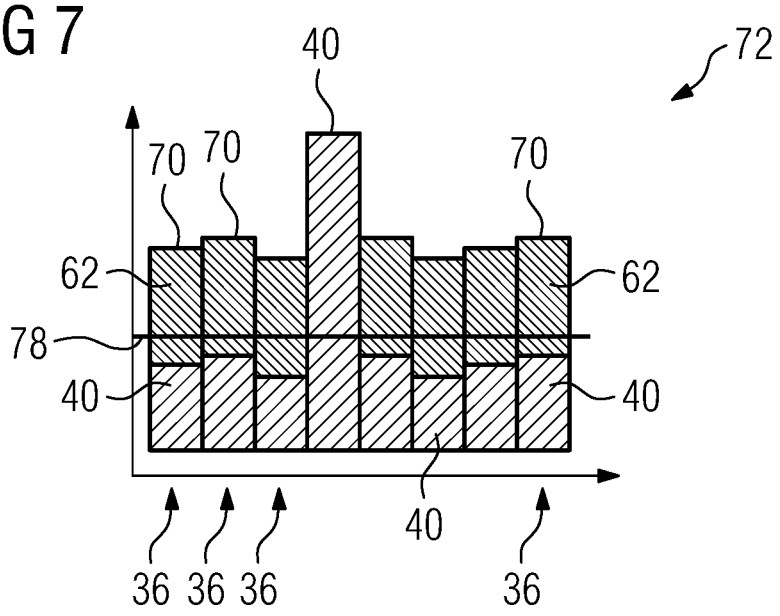
FIG. 7 shows an adapted data record.

In a fifth operating step 52, therefore, a number of prognostic values 54 is therefore generated at the transmitter end by means of the preceding channel values 44, each of the prognostic values 54 being allocated to one of the channels 36 and thus also to one of the current channel values 40, as shown in FIG. 6. The channel value 44 preceding in time allocated to the same channel 36 is utilized as prognostic value 54.

In a subsequent sixth operating step 56, a reference value 58 of the prognostic values 54 is determined, the maximum of the prognostic values 54 being utilized as reference value 58. In other words, the largest of the prognostic values 54 and thus the largest of the preceding channel values 44 is determined.

To the remaining prognostic values 54 is allocated a gain factor 62 in each case in a seventh operating step 60, the gain factors 62 differing. Thus, gain factors 62 are allocated to the channels 36 for the time window 34, each of the gain factors 62 being allocated to precisely one of the current channel values 40—with the exception of the current channel value 40 to which the reference value 68 is allocated. Each of the gain factors 62 is determined with the formula $$G_i = w\Delta L_i$$

where w is an arbitrary factor between zero (0) and one (1), for example 0.5. $G_i$ is the gain factor 62 which is allocated to channel 36 having the index i. $\Delta L_i$ designates the difference 64 between the reference value 58 and the prognostic value 54 which is allocated to the channel 36 having the index i. In consequence, all of the gain factors 62 differ and the respective gain factor 62 is generated by means of the respectively allocated prognostic value 54 to which the gain factor 62 is allocated.

Figure 8:
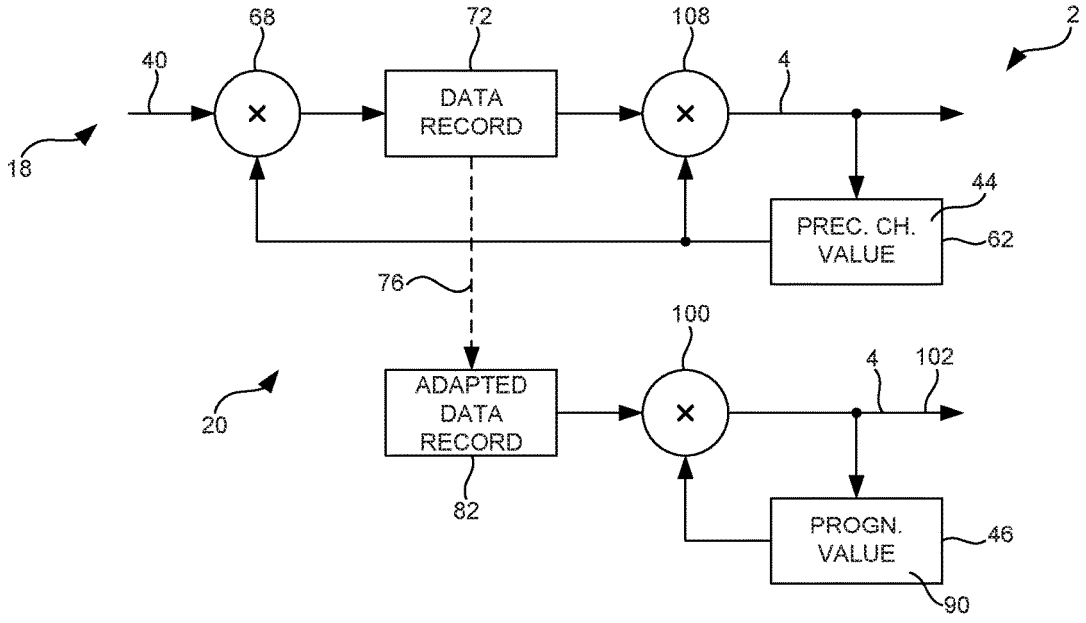
FIG. 8 diagrammatically shows sections of the hearing device system.

In a subsequent eighth operating step 68, each of the current channel values 40 is modified by means of that gain factor 54 which is allocated to the respectively allocated prognostic value 54 and generated by means of the latter. Thus, each of the current channel values 40, with the exception of that current channel value 40 to which the reference value 58 is allocated and to which, in consequence, none of the gain factors 52 is allocated, is modified to form an adapted channel value 70. The respective current channel value 40 is multiplied by the gain factor 62 allocated in each case as, for example, shown diagrammatically in FIG. 8. Thus, the respective gain factor 54 is chosen in such a manner that a deviation between the allocated prognostic value 54 and the reference value 58 would be greater than a deviation between the reference value 58 and the prognostic value modified by means of the gain factor 54. Since the current channel values 40 in most cases deviate only comparatively little from the respective channel value 44 preceding in time, the deviation between the current channel value 40 to which the reference value 58 is allocated and the adapted channel values 70 is thus also reduced.

The adapted channel values 70 and the current channel value 40 to which the reference value 58 is allocated are allocated to an adapted data record 72 which is thus a vector which has precisely the same number of elements as there are current channel values 40. In a ninth operating step 74, the adapted data record 72 is quantized by means of a spherically logarithmic quantization and a transmission value 76 is formed which is unidimensional in consequence. In other words, the transmission value 76 is generated by means of quantization of the adapted data record 72, the spherically logarithmic quantization being utilized as quantization. Due to the quantization, a second noise level 78 is introduced into the adapted data record 72. The transmission value 76 is transmitted to the remaining hearing device 4 as component of the data signal 22.

Figure 9:
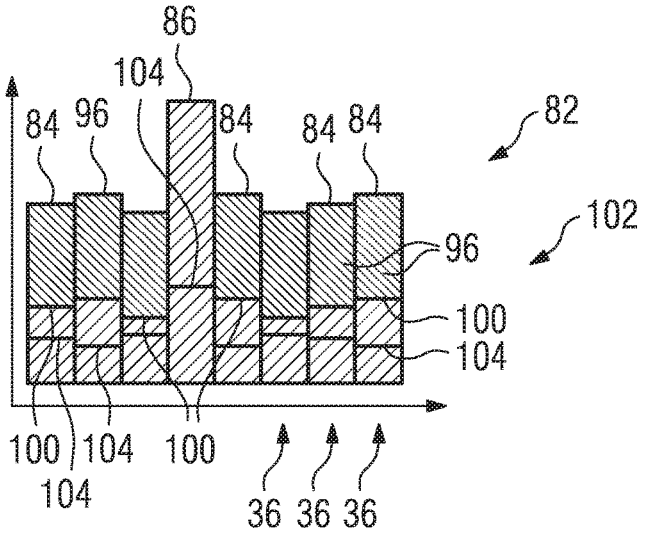
FIG. 9 shows a reconstructed adapted data record and a reconstructed output signal.

The transmission value 76 is received by means of the receiver 20 and a tenth operating step 80 is carried out in which a reconstructed adapted data record 82, which is shown in FIG. 9, is generated by means of the transmission value 76 at the receiver end. This corresponds to the adapted data record 72 with the exception of any noise which has been introduced due to the quantization. In other words, the reconstructed adapted data record 82 has a number of reconstructed adapted channel values 84 corresponding to the number of adapted channel values 70, each of the reconstructed adapted channel values 84 corresponding to one of the adapted channel values 70 and, in particular, conforming to this one. Furthermore, the reconstructed adapted data record 82 has a reconstructed unadapted channel value 86 which corresponds to the current channel value 40 allocated to the reference value 58 of the prognostic values 54 and thus is essentially the only current channel value 40 which, with the exception of the quantization, has been transmitted essentially unchanged from the transmitter 18 to the receiver 20.

In an eleventh step 88, a number of receiver-end prognostic values 90 is generated at the receiver end by means of the reconstructed preceding channel values 46, one of the receiver-end prognostic values 90 being allocated in each case to the reconstructed adapted channel values 84 and the reconstructed unadapted channel value 86. In a twelfth operating step 92, a maximum of the receiver-end prognostic values 92 is determined and in this way the reconstructed unadapted channel value 86 is identified within all values of the reconstructed adapted data record 82. In a subsequent thirteenth operating step 84, receiver-end gain factors 96 are determined by means of the receiver-end prognostic values 90 and the receiver-end maximum of the receiver-end prognostic values 90. Each of the receiver-end gain factors 96 is in each case allocated to one of the reconstructed adapted channel values 84 and the respective receiver-end prognostic values 90. Since the reconstructed preceding channel values 48 substantially correspond to the preceding channel values 44, the prognostic values 54 and the receiver-end prognostic values 90 correspond to one another. For the determination of the receiver-end gain factors 96, the same calculating rule is used as for determining the gain factors 62 which is present at the transmitter 18. The receiver-end gain factor 96 which corresponds to the transmitter-end gain factor 62 is here allocated to the same channel 36.

In summary, the eleventh, twelfth and thirteenth operating step 88, 92, 94 essentially correspond to the fifth, sixth and seventh operating step 52, 56, 60, wherein, however, different input data are utilized, namely one time the channel values 44 preceding in time and the other time the reconstructed preceding channel values 48 which, however, are equal due to the fourth operating step 46 and the third operating step 42. Thus, each gain factor 62 is equal to the transmitter-end gain factor 96 which is allocated to the same channel 36 in each case. Transmission of the gain factor 96 from the transmitter 18 to the receiver 20 is not required.

In a fourteenth operating step 98, each of the reconstructed adapted channel values 84 is modified at the receiver end by means of the receiver-end gain factor 96 allocated in each case to form a reconstructed channel value 100 and combined with the reconstructed unadapted channel value 86 to form a reconstructed output signal 102, which thus, with exception of noise introduced due to quantization, corresponds to the current channel values 40 which are present at the transmitter 18. In this context, a third noise level 104 is present due to the quantization which noise level is different with each of the channels 36. Thus, the third noise level 104 is in each case below the reconstructed channel value 100 or the reconstructed unadapted channel value 86, respectively, which is why an audio quality is improved. When the method 26 is carried out again, the reconstructed output signal 102 is utilized at least partially as the reconstructed preceding channel values 48. In a subsequent fifteenth operating step 106, the reconstructed output signal 102 is transferred into the time domain and output by means of the loudspeaker 14.

Furthermore, a sixteenth operating step 108 is carried out at the transmitter 18 in which, by means of the transmission value 76 and the gain factors 62, channel values 110 reconstructed at the transmitter end and an unadapted channel value 112 reconstructed at the transmitter end are generated which correspond to the reconstructed channel values 100 and the reconstructed unadapted channel value 86, respectively. In other words, the reconstructed output signal 102 is also generated at the transmitter 18. The channel values 110 reconstructed at the transmitter end and the unadapted channel value 112 reconstructed at the transmitter end are utilized as the channel values 44 preceding in time in the case of a transmission following in time. In this way, any deviation which is present due to the spherically logarithmic quantization in the reconstructed output signal 102 is also present at the receiver 18 which is why a deviation is reduced in the case of a subsequent transmission.

The invention is not restricted to the exemplary embodiment described above. Instead, other variants of the invention can also be derived therefrom by the expert without departing from the subject matter of the invention. In particular, all individual features described in conjunction with the exemplary embodiment can also be combined with one another in other ways without departing from the subject matter of the invention.

The following is a summary list of reference numerals and the corresponding structure used in the above description of the invention:

2 Hearing device system
4 Hearing aid
6 Housing
8 Microphone
10 Sound transducer
12 Signal processing unit
14 Loudspeaker
16 Audio signal
18 Transmitter
20 Receiver
22 Data signal
24 Communication facility
26 Method
28 First operating step
30 Second operating step
32 Input signal
34 Time window
36 Frequency channel
38 Frequency-pass filter
40 Current channel value
42 Third operating step
44 Channel values preceding in time
46 Fourth operating step
48 Reconstructed preceding channel values
50 First noise level
52 Fifth operating step
54 Prognostic value
56 Sixth operating step

58 Reference value
60 Seventh operating step
62 Gain factor
64 Difference
68 Eighth operating step
70 Adapted channel value
72 Adapted data record
74 Ninth operating step
76 Transmission value
78 Second noise level
80 Tenth operating step
82 Reconstructed adapted data record
84 Reconstructed adapted channel value
86 Reconstructed unadapted channel value
88 Eleventh operating step
90 Receiver-end prognostic value
92 Twelfth operating step
94 Thirteenth operating step
96 Receiver-end gain factor
98 Fourteenth operating step
100 Reconstructed channel value
102 Reconstructed output signal
104 Third noise level
106 Fifteenth operating step
108 Sixteenth operating step
110 Transmitter-end reconstructed channel value
112 Transmitter-end reconstructed unadapted channel value

The invention claimed is:

1. A method for transmitting an audio signal from a transmitter to a receiver, the method comprising:

at a transmitter end:

dividing an input signal representing the audio signal into a plurality of channels for a particular time window;

allocating a current channel value to each channel of the plurality of channels;

generating a plurality of prognostic values by way of preceding channel values that are allocated to a time window preceding in time, and allocating one of the prognostic values to each current channel value;

determining a reference value;

determining a gain factor by way of the reference value and allocating the gain factor to one of the prognostic values, and modifying the current channel value associated with the one prognostic value by the gain factor to form an adapted channel value;

allocating the adapted channel value to an adapted data record;

transmitting a transmission value corresponding to the adapted data record from the transmitter to the receiver;

at a receiver end:

generating a reconstructed adapted data record with a reconstructed adapted channel value which corresponds to the adapted channel value by way of the transmission value;

generating a plurality of receiver-end prognostic values by way of reconstructed preceding channel values, one of the receiver-end prognostic values being allocated to the reconstructed adapted channel value;

allocating a receiver-end gain factor to the reconstructed adapted channel value by way of the allocated receiver-end prognostic value;

modifying the reconstructed adapted channel value by way of the receiver-end gain factor to form a reconstructed channel value; and adding the reconstructed channel value to a reconstructed output signal.

2. The method according to claim 1, which comprises using a maximum of the prognostic values as the reference value.

3. The method according to claim 2, which comprises:

at the transmitter end, allocating the current channel value, to which the maximum of the prognostic values is allocated, to the adapted data record;

at the receiver end, generating the reconstructed adapted data record using the transmission value with the reconstructed adapted channel value that corresponds to the adapted channel value and with a reconstructed unadapted channel value that corresponds to the current channel value allocated to the maximum of the prognostic values; and at the receiver end, combining the reconstructed channel value and the reconstructed unadapted channel value to form the reconstructed output signal.

4. The method according to claim 1, which comprises choosing the gain factor such that a deviation between the prognostic value allocated to the gain factor and the reference value would be greater than a deviation between the reference value and the prognostic value modified by way of the gain factor.

5. The method according to claim 1, which comprises using as the prognostic value (54 the preceding channel value allocated to the same channel.

6. The method according to claim 1, which comprises generating the gain factor and the receiver-end gain factor by way of the prognostic value to which the gain factor is allocated and, respectively, by way of the receiver-end prognostic value which is allocated to the reconstructed adapted channel value.

7. The method according to claim 6, which comprises generating the gain factor from a difference between the reference value and the prognostic value.

8. The method according to claim 1, which comprises allocating a gain factor to each of the remaining prognostic values.

9. The method according to claim 8, wherein the gain factors differ from one another.

10. The method according to claim 1, which comprises dividing the input signal into the frequency channels by way of band-pass filters.

11. The method according to claim 1, which comprises generating the transmission value by quantizing the adapted data record.

12. The method according to claim 11, which comprises, a the transmitter end, generating by way of the transmission value and the gain factor a transmitter-end reconstructed channel value, which corresponds to the reconstructed channel value and which, during a transmission following in time, is utilized as one of the channel values preceding in time.

13. The method according to claim 11, which comprises quantizing utilizing a vector quantization.

14. The method according to claim 11, which comprises quantizing utilizing a spherical logarithmic quantization.

15. A hearing device, comprising a communication facility having a transmitter and a receiver configured for transmitting and/or receiving an audio signal by carrying out the method according to claim 1.

16. The hearing device according to claim 15 configured as a hearing aid.

17. A hearing device system, comprising two hearing devices each having a communication facility with a transmitter and a receiver configured for transmitting audio signals between said two hearing devices, each said communication facility being configured for transmitting and/or receiving the audio signals by carrying out the method according to claim 1.

* * * * *